United States Patent [19]

Gasser et al.

[11] 4,332,130

[45] Jun. 1, 1982

[54] APPARATUS FOR INFEEDING TEXTILE BAND MATERIAL TO A CONSUMER

[75] Inventors: Hermann Gasser, Zurich; Paolo di Benedetto, Uster; Johann W. Ferri, Greifensee, all of Switzerland

[73] Assignee: Luwa AG, Zurich, Switzerland

[21] Appl. No.: 164,292

[22] Filed: Jun. 30, 1980

[30] Foreign Application Priority Data

Jul. 10, 1979 [CH] Switzerland ..... 6417/79

[51] Int. Cl.[3] ..... D01H 15/00; B65H 17/32; B65H 51/16; D01H 13/04

[52] U.S. Cl. ..... 57/279; 28/272; 57/90; 57/350; 226/97

[58] Field of Search ..... 57/90, 293, 308, 350, 57/301, 304, 352, 279, 280; 28/271–273; 226/7, 97

[56] References Cited

U.S. PATENT DOCUMENTS

| | | | |
|---|---|---|---|
| 3,191,831 | 6/1965 | Bunting, Jr. et al. | 226/97 X |
| 3,448,571 | 6/1969 | Tsuzuki | 57/293 X |
| 3,469,385 | 9/1969 | Tsuzuki | 57/308 |
| 3,564,829 | 2/1971 | Tsuzuki | 57/90 X |
| 3,930,602 | 1/1976 | Vorobiev et al. | 226/97 X |
| 4,003,195 | 1/1977 | Fernstrom et al. | 57/350 X |
| 4,005,566 | 2/1977 | Hawkins | 57/350 |
| 4,073,421 | 2/1978 | Reufer | 226/97 |
| 4,181,247 | 1/1980 | McFall | 28/273 X |

*Primary Examiner*—John Petrakes

*Attorney, Agent, or Firm*—Werner W. Kleeman

[57] ABSTRACT

An apparatus for infeeding textile band material to a consumer, especially for infeeding a sliver deposited in a can to a spinning machine, comprising a transport tube extending between a feed location and a consumer. There is provided means for generating, within the transport tube, an infeed flow or current which flows in the direction of the consumer. Also, holder means are operatively correlated with an inlet opening of the transport tube in order to hold a starting portion of the sliver or other band-like material, such holder means enabling seizing of the starting portion of the sliver with the aid of the infeed flow.

22 Claims, 8 Drawing Figures

Fig.6
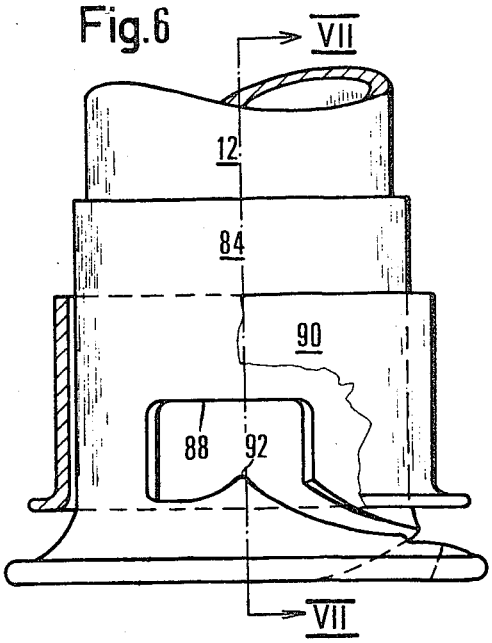
Fig.7
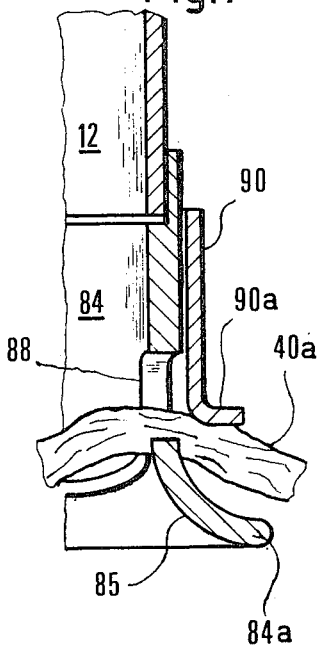
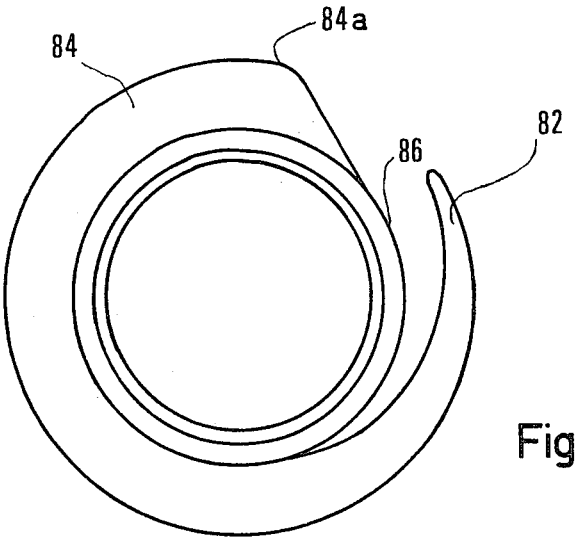
Fig. 8

APPARATUS FOR INFEEDING TEXTILE BAND MATERIAL TO A CONSUMER

CROSS REFERENCE TO RELATED CASE

This application is related to the commonly assigned copending U.S. applications Ser. Nos. 06/164,321, filed June 30, 1980, 06/164,066, filed June 30, 1980, 06/164,068, filed June 30, 1980 and 06/164,067, filed June 30, 1980.

BACKGROUND OF THE INVENTION

The present invention relates to a new and improved construction of apparatus for infeeding textile band material to a consumer.

Generally speaking, the apparatus for the infeed of textile bands of material to a consumer, especially for the infeed of a sliver or the like which has been deposited in a can to a spinning machine, contains a transport tube or pipe extending between a feed location and the consumer. The term "sliver" as used in the context of this disclosure is employed in its broader sense to cover slivers, slubbing, roving and generally band-like materials.

At textile machines which process slivers which have been deposited in cans, it is conventional practice to accomplish the sliver transport between the can and the textile machine by means of transport tubes or pipes, within which there prevails a transport air flow or current generated by a negative pressure source provided at the textile machine. Such equipment, which for instance replace conventional creels at drafting arrangements, basically operate in an extremely satisfactory fashion. However, the infeed of new slivers with the prior art equipment is at least still cumbersome. The transport air flow generated by the negative pressure source, as a general rule, is not adequate in order to seize the starting portion of the sliver, unless such sliver starting portion is inserted over a sufficient length thereof manually into the related transport tube. In other instances, the transport air current, during the sliver infeed, cannot be maintained since the machine needed for drawing-in the new slivers must be opened.

Furthermore, each drawing-in of a new sliver requires a movement of the operator between the machine and the inlet opening of the transport tube and back again, something which is particularly significant in terms of increased operating and servicing time of the equipment when working at large machines, for instance flyers, having over one hundred spindles.

SUMMARY OF THE INVENTION

Therefore, with the foregoing in mind it is a primary object of the present invention to provide a new and improved construction of apparatus for the infeed of textile band material to a consumer, in a manner not afflicted with the aforementioned drawbacks and limitations of the prior art proposals.

Another and more specific object of the invention aims at simplifying the infeed of new band material to a textile consumer in a manner simplifying the operation and servicing time of the equipment.

Still a further significant object of the present invention resides in providing a new and improved construction of apparatus for infeeding textile band material to a consumer, meaning a textile machine which processes or otherwise uses the infed textile band material, in a manner enabling the infed starting portion of the band material to be positively and reliably fed to the consumer in a rapid and efficient manner.

A further significant object of the present invention relates to a new and improved construction of apparatus for infeeding textile band materials, especially slivers, to a consumer, which apparatus is relatively simple in construction and design, extremely reliable in operation, economical to manufacture, not readily subject to breakdown or malfunction and requires a minimum of maintenance and servicing.

In order to realize the aforementioned objectives, the invention exploits the general inventive concept that there are conjointly rendered possible the preparatory steps for the infeed of the sliver material for all of the feed locations or feeders of a textile machine, and that the infeed of the sliver material itself is exclusively accomplished by an infeed flow which can be obtained independently of the operating condition of the machine.

In its more specific aspects, the apparatus for the infeed of textile band material to a consumer, especially for the infeed of a sliver deposited in a sliver can to a spinning machine, comprises means for generating within the transport tube or pipe an infeed flow or current which flows in the direction of the consumer. Also, holder means are operatively associated with the inlet opening of the transport tube, such holder means serving for seizing the starting portion of the sliver under the action of the infeed flow.

According to a preferred constructional manifestation of the invention, the holder means are movable relative to the inlet opening of the transport tube in a manner, for instance, such that a sliver starting portion of a sliver reserve can, and which sliver starting portion is seized by the holder means, after completion of the sliver supply at a feed or supply can, is brought out of a preparatory position, preferably automatically, into an infeed position located forwardly of the inlet opening. The construction of the holder means is advantageously chosen such that the holder means, after seizing the starting portion of the sliver by virtue of the infeed flow, then releases the sliver so that the holder means can return back into its preparatory position in order to receive a new sliver starting portion of a reserve can.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 6 is an elevational view, partly in section, of a further embodiment of holder means;

FIG. 7 is a sectional view of the arrangement of FIG. 6, showing a different position of the parts thereof, the section being taken along the line VII—VII thereof; and FIG. 8 is a top plan view showing a mouth piece for the embodiment shown in FIG. 6.

DETAILED DESCRIPTION OF THE PREFERRED EMBODIMENTS

Figure 1:
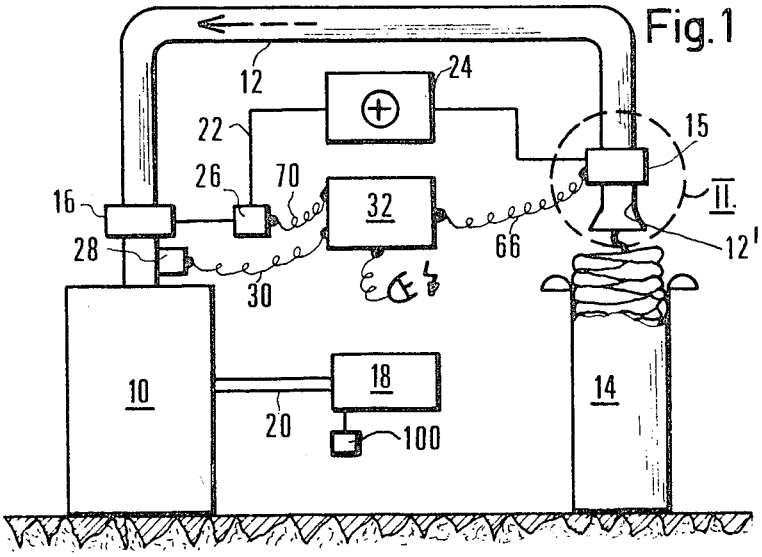
FIG. 1 illustrates a first exemplary embodiment in schematic elevational view of an infeed apparatus for band material according to the invention.

Describing now the drawings, reference character 10 designates a suitable textile machine, here assumed to be a spinning machine which constitutes a consumer of textile band material, particularly for instance slivers. The spinning machine 10 is operatively associated at each work position, for instance at the spindles, by a transport tube or pipe 12 with a can 14 containing a sliver. The transport tube or pipe 12 terminates at the textile machine 10 directly in front of a conventional drafting arrangement.

In order to be able to transport sliver material out of the cans into the textile machine, there is provided conjointly for all of the transport tubes or pipes 12, in other words, operatively associated with the spinning machine 10, a suitable source of negative pressure, such as generally indicated by reference character 100. This negative pressure source 100 generates in the transport tubes 12 an air flow or current which is directed towards the spinning machine 10.

As the negative pressure source 100 there may be provided, by way of example and not limitation, a standard ventilator arranged at the central air conditioning or climatizing station 18. This central air conditioning or climatizing station 18, which can advantageously service a number of textile machines 10, is operatively connected with the related textile machine 10 by means of a channel or conduit system 20. The negative pressure source 100 can be however also provided individually for each separate spinning machine 10. In order to draw the sliver into the spinning machine 10 there is required a greater negative pressure than for the transport of the sliver, so that already for energy saving reasons it is advantageous to provide a separate negative pressure source for drawing-in the sliver, indicated by reference character 40 in FIG. 2.

In the illustrated preferred exemplary embodiment of the invention the special or separate source of negative pressure is constituted by a compressed air injector 16 arranged at the direct neighborhood of the spinning machine 10 within the transport tube 12. This compressed air injector 16 is connected by means of a pressure line or conduit 22, which can be closed by a suitable closure element, here a valve 26, with a compressed air container or reservoir 24. Moreover, the valve 26 is connected by means of a line 70 with a control cabinet 32.

Between the injector 16 and the textile machine 10 there is arranged within the transport tube or pipe 12 a sliver sensor or feeler 28. The sensor or feeler 28 is connected by means of a line 30 with the control cabinet 32. The control cabinet 32 or equivalent structure is additionally connected by means of a line 66 with holder means 15 arranged at the starting portion or infeed end 12' of the transport tube 12.

Figure 2:
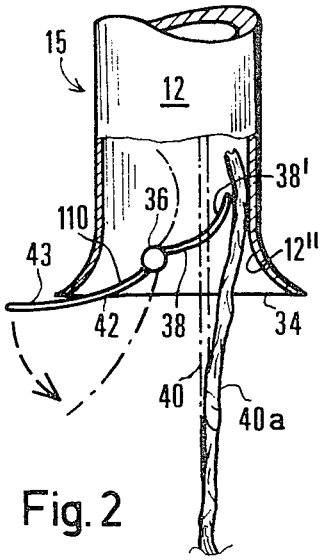
FIG. 2 is a fragmentary detail showing, on an enlarged scale and partially in section, of part of the arrangement shown in FIG. 1.

In FIG. 2 there has been shown an exemplary embodiment of the holder means, generally designated by reference character 15 in FIG. 1, and on an enlarged scale.

A shaft 36 is arranged adjacent the inlet opening 34 of the transport tube 12, this shaft 36 extending transversely with respect to the lengthwise direction of such transport tube. The shaft 36 is mounted to be pivotable in or at the transport tube 12. This shaft 36 carries a double-arm clamping element 110 having the two arms 38 and 43. The one arm 38 of this double-arm clamping element 110 is located completely within the tube 12 and initially extends at a slight inclination upwardly away from the shaft 36 and in the direction of the tube wall 12'' and then is almost bent in vertical direction. Between the free end 38' of the arm 38 and the tube wall 12'' there is clamped the starting portion **40*a* of a sliver 40. The second arm 42 extends in the opposite direction, away from the shaft 36, downwardly at a slight inclination in the direction of the edge 12*a* of the transport tube and past such edge, having a protruding portion 43 which renders possible accomplishment of the pivotal movement of the clamping element 110**.

Upon presence of an infeed flow or current internally of the transport tube 12 the double-arm clamping element 110, composed of the arms 38, 42, is automatically rocked into the phantom line or chain-dot position, the sliver starting portion **40*a* is drawn further into the transport tube 12, and the clamping element 110 practically no longer constitutes any resistance for the throughpassage of the following portion of the sliver 40**, shown in phantom lines.

Figure 4:
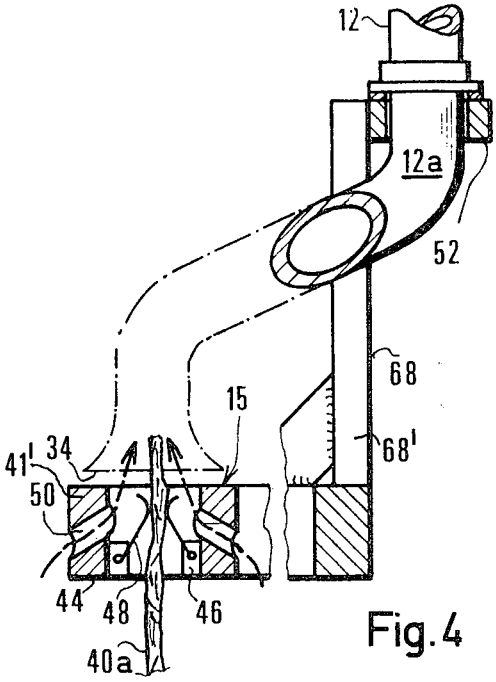
FIG. 4 is a vertical sectional view, on an enlarged scale, of the arrangement of FIG. 3, taken substantially along the line IV—IV thereof.
Figure 3:
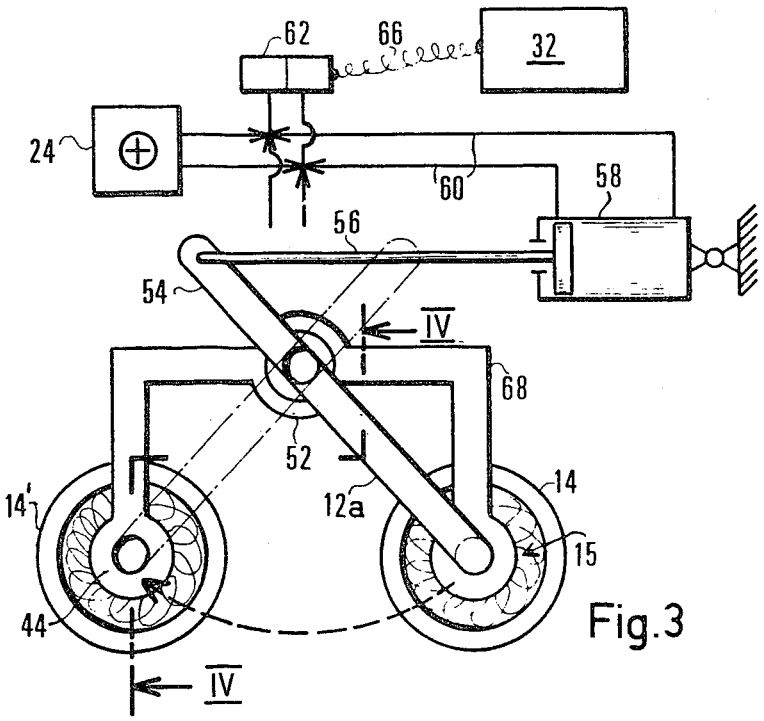
FIG. 3 is a schematic top plan view of a second embodiment of the invention.

In FIGS. 3 and 4 there has been illustrated a further embodiment of textile infeeding apparatus on an enlarged scale. In contrast to the embodiment shown in FIG. 1, here the portion of the transport tube 12, which descends in the direction of the can 14, has a double-curved end portion or section **12*a* which is pivotably mounted within a bearing or support arrangement 52. At the region of the bearing 52 there is secured at the end portion or section 12*a* a bracket or protruding member 54 at which engages the thrust rod 56 of a suitable fluid-operated, for instance pneumatic positioning or adjustment motor 58. This positioning motor 58 is connected by means of a pair of lines 60, controlled by an electromagnetic valve 62, with the compressed air container 24. The electromagnetic valve 62 is connected by means of a line 66 with the control cabinet 32**.

Secured to the bearing 52 are two support arms 68, which support at their free ends 68' a respective ring member or ring 44. These ring members 44 are located parallel to the inlet opening 34 of the transport tube 12. The inlet opening 34 can be brought into alignment with the openings of the rings or ring members 44, each of which is operatively associated with a respective one of the cans 14, by pivoting the end portion **12*a* of the transport tube 12 with the aid of the positioning or adjustment motor 58. The end portion or section 12*a* of the transport tube 12 can be moved out of the position shown in full lines in FIG. 3 over the feed can 14 from which there is momentarily being delivered sliver, into the position shown in broken lines which is operatively correlated with the reserve sliver can 14'**.

Continuing, as best seen by referring to FIG. 4, internally of each ring member 44 there are pivotably mounted at diametrically oppositely situated projections or protuberances 46 the lamellae or blades 48 or equivalent structure forming the holder means 15. These blades or lamellae 48 are domed of curved towards one another in a slightly convex configuration and extend upwards from the projections 46. These lamellae 48 fixedly retain therebetween the sliver starting portion 40*a*, but however afford practically no resistance for the throughpassage of the sliver 40 in upward direction, and such sliver movement is augmented by the negative pressure which prevails due to sucking-in air through the openings 50. These openings 50 extend at an inclination inwardly and upwardly through the wall 44' of the related ring member 44.

Also conceivable for use as the holder means is a ring-shaped hook whose opening is arranged approximately coaxially with respect to the inlet opening 34 and which is structured such that a sliver can be fixedly held, but upon application of an air flow affords practically no resistance for the throughpassage of the sliver through the hook.

Instead of forming the holder means 15 merely by using a hook, it is also conceivable, and within the teachings of the invention, to employ a movable clamping element which is operatively associated with the hook. Such construction of a holder means has been illustrated in FIGS. 6, 7 and 8. In particular, reference character 82 designates a finger-shaped hook provided at the free end of a mouth piece or element 84, which is seated upon the end of the transport tube 12 neighboring the can 14. In order to form the hook 82 there is formed at the mouth piece or element 84 a slot 86 which starts from its marginal region or edge 84*a* which limits an inlet opening 85. This slot 86 extends approximately in the circumferential direction and terminates at a widened portion 88. Axially displaceably mounted upon the mouth piece or element 84 is a sleeve 90 which surrounds such mouth piece 84. In the position shown in FIG. 6, assumed by the sleeve 90 under the action of the force of gravity, when no sliver is attached at the hook 82, the sleeve 90 bridges part of the slot 86 and its widened portion 88.

On the other hand, as best seen by referring to FIG. 7, the sleeve 90 is raised in relation to the rest position depicted in FIG. 6, when in the widened portion 88 of the slot 86 there is located a sliver starting portion, again designated by reference character 40*a*. The sleeve 90 bears by means of its lower edge 90*a*, under the action of its inherent weight upon the sliver starting portion 40*a* which protrudes through the widened portion 88 out of the mouth piece or element 84, retaining such sliver starting portion 40*a* in a preparatory position, while the sliver 40 extends out of the mouth piece 84*a* axially towards the sliver can. In order to bring the sliver starting portion 40*a* into the preparatory position shown in FIG. 7, it is merely necessary to suspend such sliver starting portion, after removal manually out of the related sliver can and moving it along the circumference of the mouth piece 84 in the clockwise direction (FIG. 8), at the hook 82 and to introduce such through the slot 86 into the widened portion 88. During the movement along the slot 86 the sleeve or sleeve member 90 is automatically raised to such an extent that the sliver starting portion 40*a* can slide over or behind a cam or dog 92 protruding into the widened portion 88. Now if the sliver starting portion 40*a* is released from the hand of the operator, then the sleeve 90 retains such sliver starting portion 40*a* clamped behind the cam or dog 92 under the action of the weight of the sleeve member 90.

If the compressed air injector 16 of the related transport tube or pipe 18 is turned-on, then the air flow which enters the mouth piece 84 draws the sliver starting portion 40*a* through the widened portion 88 into the transport tube 12. The sliver starting portion 40*a* slides below the sleeve edge 90*a* and is guided, under the action of the infeed air flow prevailing within the transport tube 12, in the direction of the textile machine 10 (FIG. 1). Hence, the sliver 40 reposing in the can 14 is withdrawn from such can. The hook or hook member 82 and the mouth piece 84 is directed in the peripheral direction such that the sliver which has been deposited in coils within the can 14, during the sliver withdrawal operation, does not become caught at the hook 82, i.e. the hook 82 extends in the same direction as the direction of rotation of the sliver 40 when it is removed from the sliver can 14.

Figure 5:
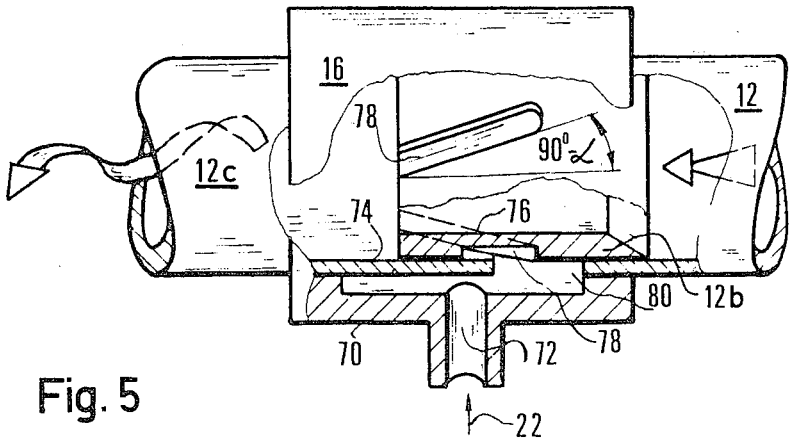
FIG. 5 illustrates an exemplary embodiment of inventive injector.

FIG. 5 shows on an enlarged scale and in sectional view the compressed air injector 16. The transport tube 12 is surrounded within the compressed air injector 16 directly by a ring-shaped or annular chamber 80. This ring-shaped chamber 80 is limited towards the outside by a substantially cylindrical pot member 70 or equivalent structure, containing a bore 72 at which there is connected the compressed air line 22 for the compressed air. Internally of the compressed air injector 16 there is located the transport tube 12 which is composed of two portions or sections 12*b*, 12*c* of different diameter, wherein the tube section 12*b* of smaller diameter, generally indicated by reference character 76, is connected with the infeed pipe and is provided at its outer periphery with uniformly distributed grooves 78 which terminate at the ring-shaped chamber 80. The tube section 12*c* of larger diameter 74 is seated upon the tube section or portion 12*b* of smaller diameter 76 and covers the grooves 78 partially along their lengthwise extent and is connected with the downstream located end of the transport tube 12. These grooves or air guide means 78 extend at an inclination angle $\alpha$ in the order of 60° to 80° and have a length amounting to about 0.8 to 1.2 of the diameter of the tube 12. The grooves 78, which flow communicate the ring-shaped chamber 80 with the interior of the transport tube 12, impart to the air at the downstream located portion of the transport tube 12 an approximately helical-shaped flow path.

Prior to placing the machine into operation a sliver 40 emanating from the related can 14 is brought at the holder means 48 or 38, as the case may be, into the preparatory position at the inlet 34 of each transport tube 12 and fixedly held at such location. The machine operator then activates, by means of a conventional and therefore not particularly illustrated manually actuatable valve, the compressed air injector 16, so that compressed air enters the compressed air injector 16 and flows along a helical-shaped path within the transport tube 12 towards the spinning machine 10. Consequently, the air column in the infeeding portion of the transport tube 12 is placed into movement in the direction of the spinning machine 10. The resultant infeed flow or air current at the mouth 34 of the transport tube 12 seizes the starting portion 40*a* of the sliver 40, while the holder means now are caused to release such sliver starting portion 40*a*. This sliver starting portion 40*a* travels through the transport tube 12 up to the region of the not particularly illustrated drafting arrangement of the spinning machine 10, whereafter the compressed air injector 16 is turned-off. Upon passage through the compressed air injector 16 the sliver 40 has imparted thereto a twist or rotation extending over a multiple of the staple length of the fibers of the sliver 40 and also at the region of the sliver which has not yet passed the compressed air injector 16. By virtue of the increased strength imparted to the sliver 40 by the twist, it is possible to manually draw the sliver through the drafting arrangement and, depending upon the nature of the textile machine, to further thread the sliver or other band-like or filamentary material through the textile machine. This operation is repeated at each work station. Upon placing into operation the spinning machine 10 the centrally arranged ventilator or fan 100 of the air climatizing installation of the spinning mill assumes the task of generating the negative pressure needed for the further operation and transport of the slivers, and thus feeds these slivers from the cans 14 through the transport tubes 12 into the spinning machine 10. The holder means remain in a position where they offer practically no resistance to the throughpassage of the sliver. The spinning operator now suspends the sliver starting portion of the reserve can which has been brought into its preparatory position, at the related holder means, with the result that now also the reserve can is ready for its operation of infeeding sliver material to the machine when called upon.

If one of the sliver sensors or feelers 28 detects the absence of a sliver, then by means of a line 30 there is triggered a pulse at the control cabinet 32. This signals to the spinning operator, through the use of any suitable means, that the sliver is missing at one of the work positions, whereupon the spinning operator eliminates the sliver rupture or places into operation a reserve sliver can and the sliver 40 is then drawn into the spinning machine 10 by manually starting the related compressed air injector 16. However, if the textile processing machine is designed such that the slivers are automatically re-pieced, then by means of the signal pulse representative of the missing sliver there is opened the electromagnetic valve 62 by means of the line 66 and the positioning or adjustment motor 58 is operatively connected with the compressed air source 24, so that the end portion 12*a* of the transport tube 12 is pivoted into the reserve position, as the same has been shown in FIG. 3 by phantom lines. After a certain amount of time the control cabinet 32 causes, by means of the line 70, opening of the valve 26, so that the compressed air injector 16 is supplied with compressed air from the compressed air source 24 by means of the line or conduit 22 and the sliver starting portion 40*a* is sucked-out of the reserve can into the spinning machine 10. The spinning operator has called to his attention, by any suitable signaling means, that the reserve can has been placed into operation, whereupon the operator then displaces the reserve can 14′ into its work position, pivots the starting portion of the transport tube 12 into the original position, places into readiness a new reserve sliver can and brings the sliver thereof into the holding means into the preparatory position.

Instead of movably structuring the end portion of the transport tube 12 located at the side of the sliver can and to operatively stationarily associate the holder means with the individual cans, it would also be possible to movably construct the holder means and to move them in conjunction with the sliver starting portions to the inlet openings 34 of the transport tubes 12. This however requires a displacement of the reserve cans to the position of the empty cans.

Of course, the use of the textile band or sliver infeed apparatus of the present development is not limited in any way to spinning machines; basically, it is suitable for use with all other types of band processing textile machines.

While there are shown and described present preferred embodiments of the invention, it is to be distinctly understood that the invention is not limited thereto, but may be otherwise variously embodied and practiced within the scope of the following claims. Accordingly,

What we claim is:

1. An apparatus for infeeding textile band material to a consumer, especially for infeeding a sliver deposited in a can to a spinning machine, comprising:

means defining a sliver feed location;

a consumer for processing the sliver;

a transport tube extending between said feed location and said consumer;

means for generating within the transport tube an air infeed current which flows in the direction of the consumer;

said transport tube having an inlet opening;

holder means operatively associated with said inlet opening of said transport tube;

said holder means in conjunction with the action of the air infeed current enabling seizing of a starting portion of said sliver; and said holder means serving for retaining the starting portion of the sliver in a preparatory position from which it can be seized by the air infeed current.

2. An apparatus for infeeding textile band material to a consumer, especially for infeeding a sliver deposited in a can to a spinning machine, comprising:

means defining a sliver feed location;

a consumer for processing the sliver;

a transport tube extending between said feed location and said consumer;

means for generating within the transport tube an air infeed current which flows in the direction of the consumer;

said transport tube having an inlet opening;

holder means operatively associated with said inlet opening of said transport tube;

said holder means in conjunction with the action of the air infeed current enabling seizing of a starting portion of said sliver;

said transport tube is adapted to be connected to a negative pressure source operatively associated with said consumer; and said means for generating said air infeed current comprises a compressed air injector connected with said transport tube.

3. The apparatus as defined in claim 2, wherein:

said holder means are connected to said transport tube.

4. The apparatus as defined in claim 1, wherein:

said holder means are connected to said transport tube.

5. The apparatus as defined in claim 4, wherein:

said holder means comprises a clamping element; and means for pivotably mounting said clamping element at said transport tube.

6. The apparatus as defined in claim 1, wherein:

said holder means comprises a hook member curved approximately coaxially with respect to said inlet opening of said transport tube.

7. The apparatus as defined in claim 6, wherein:

said means defining a sliver feed location comprising a can;

said sliver upon removal from the can rotating in a predetermined rotational sense;

said transport tube having a lengthwise axis;

said hook member being arranged approximately transversely with respect to said lengthwise axis of said transport tube and extending in the direction of the rotational sense of the sliver during its outfeed from the can; and a movable clamping element cooperating with said hook member.

8. The apparatus as defined in claim 7, wherein:

said transport tube is provided with a mouth piece containing said inlet opening;

said mouth piece possessing a slot extending over a portion of its circumference and opening at the circumference of said mouth piece; and said slot forming said hook member.

9. The apparatus as defined in claim 8, further including:

a sleeve member forming said clamping element;

said sleeve member surrounding said mouth piece and being axially displaceably mounted upon said mouth piece; and said sleeve member being retained in a clamping position covering part of said slot.

10. The apparatus as defined in claim 9, wherein:

said sleeve member is retained in said clamping position under the action of the force of gravity.

11. The apparatus as defined in claim 1, wherein:

said holder means and said transport tube are movable relative to one another approximately in horizontal direction.

12. An apparatus for infeeding textile band material to a consumer, especially for infeeding a sliver deposited in a can to a spinning machine, comprising:

means defining a sliver feed location;

a consumer for processing the sliver;

a transport tube extending between said feed location and said consumer;

means for generating within the transport tube an air infeed current which flows in the direction of the consumer;

said transport tube having an inlet opening;

holder means operatively associated with said inlet opening of said transport tube;

said holder means in conjunction with the action of the air infeed current enabling seizing of a starting portion of said sliver;

said holder means and said transport tube being movable relative to one another approximately in horizontal direction;

said transport tube includes an end portion possessing said inlet opening; and said end portion being movable between two horizontally spaced positions.

13. The apparatus as defined in claim 12, wherein:

said inlet opening in both positions of said end portion is arranged above said holder means.

14. The apparatus as defined in claim 13, wherein:

said transport tube is adapted to be connected to a negative pressure source operatively associated with said consumer;

said means for generating said air infeed current comprises a compressed air injector connected with said transport tube; and said control circuit containing a switching element for the compressed air injector.

15. The apparatus as defined in claim 12, further including:

positioning motor means operatively associated with said movable end portion; and an actuation element for controlling said positioning motor means.

16. The apparatus as defined in claim 15, wherein:

means defining a control circuit containing said actuation element; and said control circuit containing a sliver sensor arranged within the transport tube.

17. An apparatus for infeeding textile band material to a consumer, especially for infeeding a sliver deposited in a can to a spinning machine, comprising:

means defining a sliver feed location;

a consumer for processing the sliver;

a transport tube extending between said feed location and said consumer;

means for generating within the transport tube an air infeed current which flows in the direction of the consumer;

said transport tube having an inlet opening;

holder means operatively associated with said inlet opening of said transport tube;

said holder means in conjunction with the action of the air infeed current enabling seizing of a starting portion of said sliver;

said transport tube is adapted to be connected to a negative pressure source operatively associated with said consumer;

said means for generating said air infeed current comprising a compressed air injector connected with said transport tube; and said compressed air injector is arranged directly neighboring the end of the transport tube located closest to the side of the consumer.

18. The apparatus as defined in claim 17, wherein:

said compressed air injector is a spin injector.

19. The apparatus as defined in claim 17, further including:

a ring-shaped chamber directly surrounding said transport tube;

said ring-shaped chamber having a compressed air connection means;

air infeed means uniformly dividing the wall of the transport tube over its circumference and extending therethrough with a predetermined exit direction; and said infeed means imparting to the air an approximately helical-shaped flow path.

20. The apparatus as defined in claim 19, wherein:

said infeed means comprises a plurality of channels distributed essentially uniformly about the circumference of said transport tube; and said channels extending at an angle of inclination in the order of between about 10° to 30°.

21. The apparatus as defined in claim 19, wherein:

said transport tube is formed of two tube sections of different diameter;

one of said tube sections, possessing the smaller diameter, being provided at its outer surface with groove means defining said air infeed means;

said groove means terminating in said ring-shaped chamber;

said tube section of larger diameter being seated upon said tube section of smaller diameter; and said groove means extending over a portion of its extent.

22. An apparatus for infeeding textile band material to a consumer, especially for infeeding a sliver deposited in a can to a spinning machine, comprising:

means defining a sliver feed location;

a consumer for processing the sliver;

a transport tube extending between said feed location and said consumer;

means for generating a negative pressure to produce an air infeed current which flows in the direction of the consumer;

said transport tube having an inlet opening;

holder means operatively associated with said inlet opening of said transport tube;

said holder means in conjunction with the action of the air infeed current enabling seizing of a starting portion of said sliver; and said generating means being structured for producing a higher negative pressure when seizing the starting portion of the sliver and threading it through the transport tube and then a lower negative pressure following such threading of the sliver for the transport of the sliver through the transport tube.

* * * * *